US010269518B2

(12) United States Patent
Tsutsumi et al.

(10) Patent No.: US 10,269,518 B2
(45) Date of Patent: Apr. 23, 2019

(54) ELECTROMAGNETIC CONTACTOR

(71) Applicant: FUJI ELECTRIC FA COMPONENTS & SYSTEMS CO., LTD., Tokyo (JP)

(72) Inventors: Takashi Tsutsumi, Kounosu (JP); Masaaki Watanabe, Kounosu (JP); Hideki Daijima, Kounosu (JP); Shota Shiinoki, Kounosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 357 days.

(21) Appl. No.: 15/222,413

(22) Filed: Jul. 28, 2016

(65) Prior Publication Data

US 2016/0365211 A1 Dec. 15, 2016

Related U.S. Application Data

(63) Continuation of application No. PCT/JP2015/001950, filed on Apr. 7, 2015.

(30) Foreign Application Priority Data

May 20, 2014 (JP) ..... 2014-104752

(51) Int. Cl.
*H01H 75/00* (2006.01)
*H01H 50/30* (2006.01)
(Continued)

(52) U.S. Cl.
CPC ..... *H01H 50/30* (2013.01); *H01H 45/04* (2013.01); *H01H 50/546* (2013.01);
(Continued)

(58) Field of Classification Search
CPC ..... H01H 50/04; H01H 50/30; H01H 50/44; H01H 50/60; H01H 45/04; H01H 51/22; H01F 7/08
(Continued)

(56) References Cited

U.S. PATENT DOCUMENTS 3,409,851 A * 11/1968 Scheib, Jr. ..... H01H 50/22 335/126
3,878,491 A 4/1975 Rauter et al.
(Continued)

FOREIGN PATENT DOCUMENTS

JP 37-7930 4/1962
JP 48-31466 4/1973
(Continued)

OTHER PUBLICATIONS

International Preliminary Report on Patentability dated Dec. 1, 2016 in corresponding to International Patent Application No. PCT/JP2015/001950.
(Continued)

*Primary Examiner* — Shawki S Ismail
*Assistant Examiner* — Lisa N Homza

(57) ABSTRACT

An electromagnetic contactor with connecting spring including: a movable core contact plate section that is inserted into a through hole formed in a movable core and comes into contact with a contact support side of the through hole; and a pair of curved plate sections each joined to either end of the movable core contact plate section and housed in connecting spring tip housing sections formed in the contact support, the sides of which opposite to a contact surface of the movable core contact plate section come into contact with the connecting spring tip housing sections. In the movable core contact plate section, a depressed section is formed in a direction crossing a longitudinal direction to
(Continued)

bulge out to an opposite side to the contact support side is formed, and contact sections that come into contact with the through hole are formed on both ends of the depressed section.

8 Claims, 8 Drawing Sheets

(51) Int. Cl.

| | |
|---|---|
| ***H01H 45/04*** | (2006.01) |
| ***H01H 50/54*** | (2006.01) |
| ***H01H 50/64*** | (2006.01) |
| *H01H 50/04* | (2006.01) |
| *H01H 50/22* | (2006.01) |

(52) U.S. Cl.
CPC ..... *H01H 50/646* (2013.01); *H01H 50/041* (2013.01); *H01H 50/22* (2013.01)

(58) Field of Classification Search
USPC ..... 335/14
See application file for complete search history.

(56) References Cited

U.S. PATENT DOCUMENTS

| | | | | |
|---|---|---|---|---|
| 4,988,964 | A * | 1/1991 | Streich | H01H 3/001 335/131 |
| 2016/0189899 | A1* | 6/2016 | Shiinoki | H01H 50/047 335/132 |
| 2016/0189901 | A1* | 6/2016 | Tsutsumi | H01H 50/60 335/84 |
| 2016/0260564 | A1* | 9/2016 | Tsutsumi | H01H 50/30 |
| 2016/0268081 | A1* | 9/2016 | Tsutsumi | H01H 50/04 |
| 2016/0293366 | A1* | 10/2016 | Tsutsumi | H01H 50/02 |
| 2016/0293370 | A1* | 10/2016 | Tsutsumi | H01H 50/14 |

FOREIGN PATENT DOCUMENTS

| | | |
|---|---|---|
| JP | 61-8929 | 1/1986 |
| JP | 2-50935 | 4/1990 |
| JP | 2009-9813 | 1/2009 |

OTHER PUBLICATIONS

International Search Report dated Jun. 30, 2015 in corresponding International Application No. PCT/JP2015/001950.

* cited by examiner

ELECTROMAGNETIC CONTACTOR

CROSS REFERENCE TO RELATED APPLICATION

This application is a U.S. Continuation application filed under 35 U.S.C. § 111(a), of PCT International Patent Application No. PCT/JP2015/001950, filed Apr. 7, 2015, and claims foreign priority benefit to Japanese Patent Application No. 2014-104752, filed May 20, 2014, the contents of which are incorporated herein by reference.

TECHNICAL FIELD

The present invention relates to an electromagnetic contactor configured to connect a movable core of an AC electromagnet and a contact support that holds movable contacts by a connecting spring.

BACKGROUND ART

As an electromagnetic contactor of this type, an electromagnetic contactor configured to drive a contact support by an AC electromagnet, as disclosed in, for example, PTL 1, has been proposed.

The electromagnetic contactor disclosed in PTL 1 has an AC electromagnet provided with a fixed iron core, a movable iron core, and an electromagnetic coil, and has a configuration in which the movable iron core of the AC electromagnet and a contact support to which movable contacts are arranged are connected to each other by means of a connecting plate formed of a band-plate-shaped plate spring.

In the above configuration, the plate spring composing the connecting plate is formed into an arc-shape the central section of which, when viewed from a side face, is bulged toward the contact support side, the plate spring is inserted into a through hole that is formed in the contact support in such a way as to penetrate in the thickness direction, and both end sections of the plate spring projecting out of the through hole are supported by holding sections formed to the contact support.

CITATION LIST

Patent Literature

PTL 1: JP 2009-009813 A (see paragraphs [0015] and [0023])

SUMMARY OF INVENTION

Technical Problem

However, in the electromagnetic contactor disclosed in PTL 1, the connecting plate connecting the movable core of the AC electromagnet and the contact support is formed of an arc-shaped plate spring the central section of which bulges toward the contact support side. For this reason, although loads exerted on points of load of both end sections of the connecting plate, which are supported by the contact support, can be equalized when the central section of the connecting plate is in contact with a central section of the movable core, loads exerted on points of load of both end sections of the connecting plate, which are supported by the contact support, are difficult to equalize when the central section of the connecting plate is in contact with a point that is displaced in the width direction from the central section of the movable core, which is a factor causing the contact support to be mounted in an inclined manner with respect to the movable core.

Accordingly, the present invention is made by focusing on the unsolved problem in the conventional example disclosed in the above-described PTL 1, and an object of the present invention is to provide an electromagnetic contactor that is capable of connecting a movable core of an AC electromagnet and a contact support securely without distorting an attitude thereof.

Solution to Problem

In order to achieve the object mentioned above, according to an aspect of the present invention, there is provided an electromagnetic contactor including: an AC electromagnet having a fixed core and a movable core; a contact support that aligns and holds a plurality of movable contacts; and a connecting spring that connects the movable core of the AC electromagnet and the contact support. The connecting spring includes: a movable core contact plate section that is inserted into a through hole formed in the movable core and comes into contact with the contact support side of the through hole; and a pair of curved plate sections that are each joined to either end of the movable core contact plate section and housed in connecting spring tip housing sections formed in the contact support, the pair of curved plate sections coming into contact with the connecting spring tip housing sections on sides opposite to a contact surface of the movable core contact plate section. In the movable core contact plate section, a depressed section that is formed in a direction crossing a longitudinal direction of the movable core contact plate section and bulges out to an opposite side to the contact support side is formed, and a pair of contact sections that individually come into contact with the through hole are formed on both ends of the depressed section.

Advantageous Effects of Invention

According to the present invention, because, in the movable core contact plate section of the connecting spring that connects the movable core of the AC electromagnet and the contact support, a depressed section bulging out to the opposite side to the contact support side is formed and a pair of contact sections each in contact with the through hole are formed on both ends of the depressed section, even when the connecting spring is inserted into the through hole of the movable core while being displaced in the width direction, the pair of contact sections coming into contact with the inside of the through hole of the movable core enables loads exerted at points of load of both ends of the connecting spring to be equalized and the movable core and the contact support to be connected without the attitude thereof being distorted.

In addition, since merely forming the depressed section to a middle plate section of the connecting spring composes a structure to maintain the relative attitude between the movable core and the contact support, it is possible to achieve a simple structure, enabling an amount of bending of the connecting spring to be reduced and a space for a connection section to be diminished.

DESCRIPTION OF EMBODIMENTS

Hereinafter, an embodiment of the present invention will be described with reference to the drawings.

Figure 1:
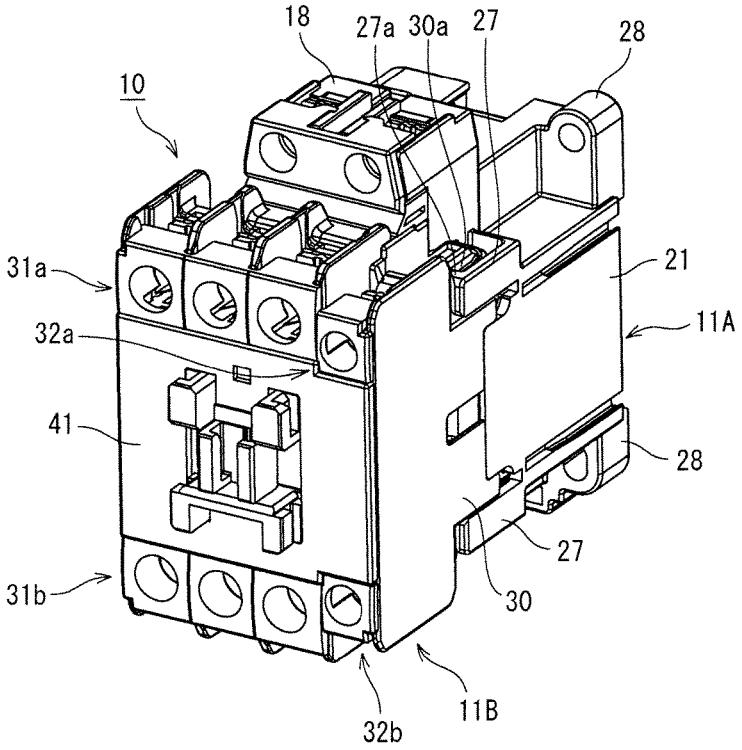
FIG. 1 is a perspective view illustrative of an electromagnetic contactor according to the present invention.

An electromagnetic contactor 10 according to the present invention is made up of synthetic resin members joined to each other, for example, a first frame 11A and a second frame 11B, both of which is made by injection-molding fiber-reinforced thermoplastic resin, such as polybutylene terephthalate (PBT), joined to each other, as illustrated in FIG. 1.

Figure 3:
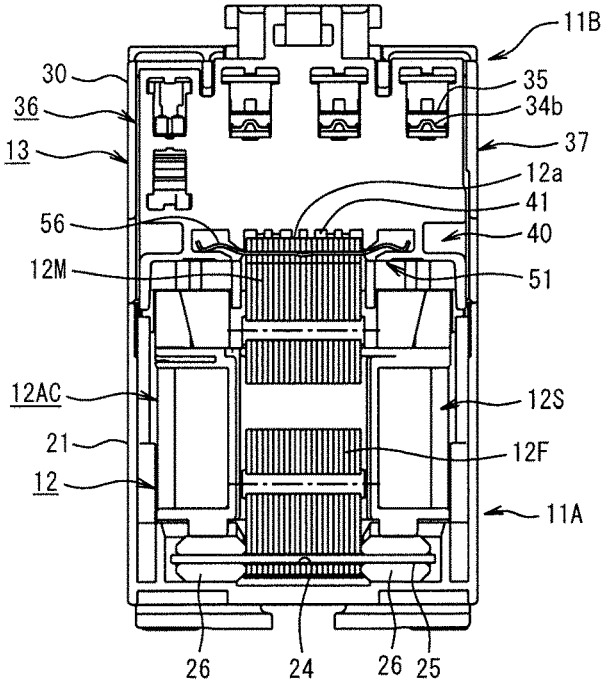
FIG. 3 is a cross-sectional view taken along the line III-III in FIG. 2.
Figure 4:
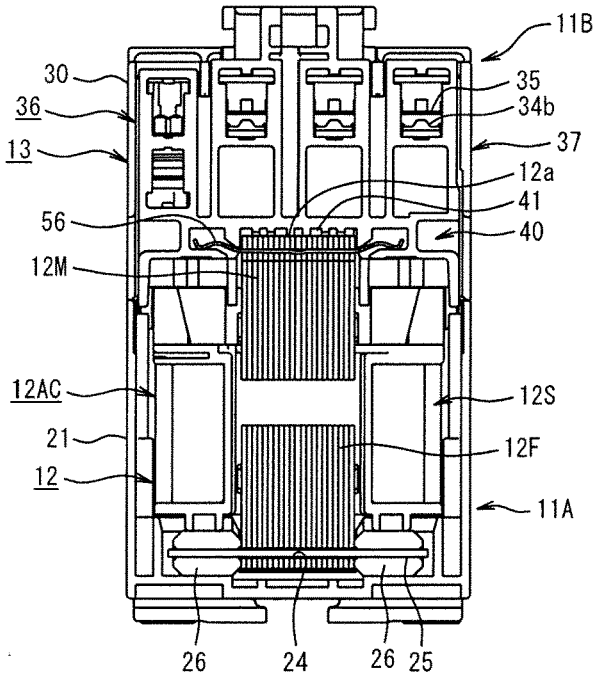
FIG. 4 is a cross-sectional view taken along the line IV-IV in FIG. 2.

In the first frame 11A, an operation electromagnet 12 is mounted, as illustrated in FIGS. 3 and 4. In the second frame 11B, a contact mechanism 13, which is on/off driven by the operation electromagnet 12, is mounted, as illustrated in FIGS. 3 and 4.

The first frame 11A has a bottomed angular cylindrical section 21, which houses the operation electromagnet 12, as illustrated in FIGS. 3 and 4.

The operation electromagnet 12 is made up of an AC electromagnet 12AC, which is provided with a fixed core 12F, a movable core 12M that is movable in the forward and backward directions with respect to the fixed core 12F, and a spool 12S around which an excitation coil 12*c* is wound.

Figure 5:
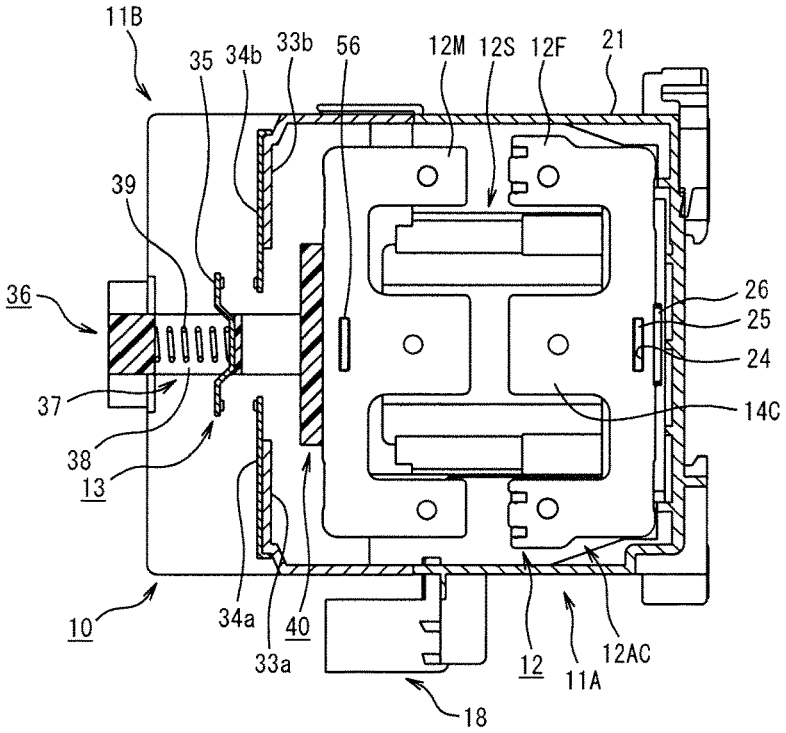
FIG. 5 is a cross-sectional view taken along the line V-V in FIG. 2.

The fixed core 12F is formed into an E-shape when viewed from the left side face, and both ends of a support plate 25 that is inserted into a through hole 24 formed at a central portion of a vertical plate section 23*a* of the fixed core 12F are elastically supported by elastic members 26 that are fixed to the bottom of the bottomed angular cylindrical section 21, as illustrated in FIG. 5.

The movable core 12M is formed into an E-shape when viewed from the right side face and, being connected to an after-mentioned contact support 36 that is supported in the second frame 11B so as to be movable in the front and rear directions, moves integrally with the contact support 36, as illustrated in FIG. 5.

Figure 6:
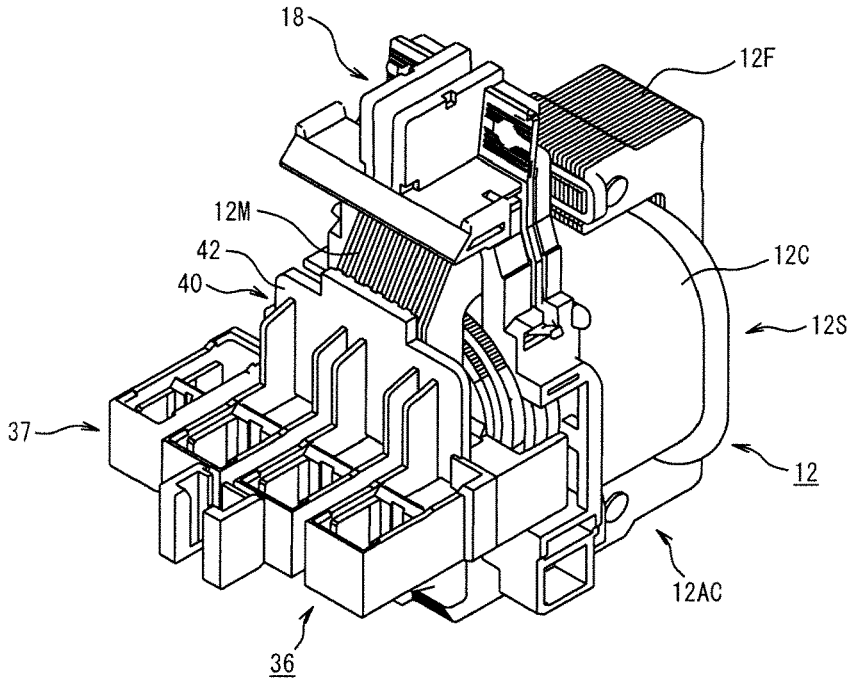
FIG. 6 is a perspective view of FIG. 1 when frames are removed and an AC electromagnet is used as an electromagnet.
Figure 7:
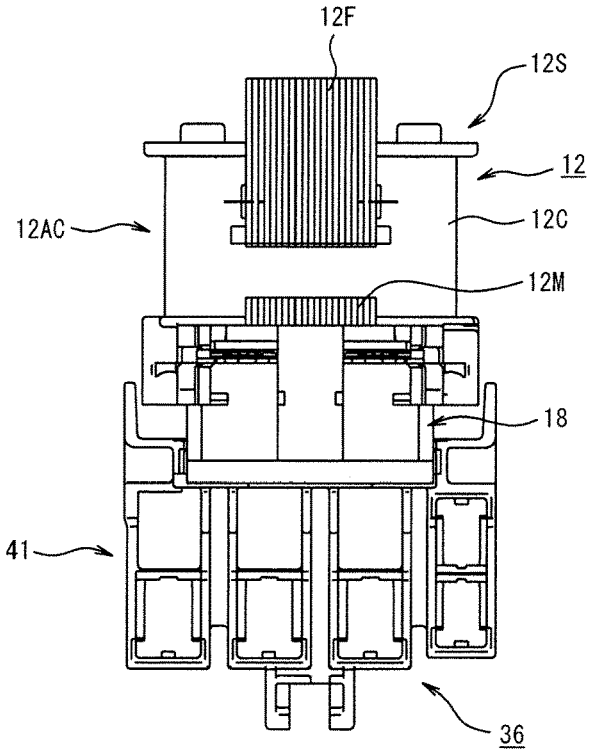
FIG. 7 is a plan view of FIG. 6.

The spool 12S is mounted on the periphery of a central projection section 14*c*, which projects to the front of the fixed core 12F, as illustrated in FIG. 5. To the spool 12S, coil terminals 18, which project upward, are formed, as illustrated in FIG. 6.

On the front ends of one pair of opposite side walls, for example, the right and left side walls, of the bottomed angular cylindrical section 21 of the first frame 11A, four hook sections 27, which compose snap fits, are formed at vertically and horizontally symmetrical positions in such a way that an engaging section 27*a* of each hook section 27 faces the inner side, as illustrated in FIG. 1.

Further, at four corners of the bottom of the bottomed angular cylindrical section 21 of the first frame 11A, mounting plate sections 28 each of which has a mounting hole are formed.

Figure 2:
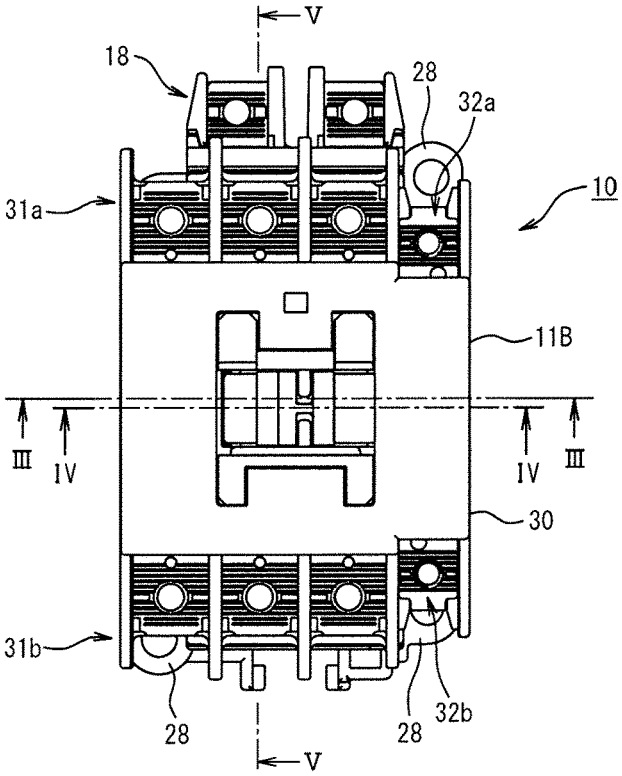
FIG. 2 is a front view of FIG. 1 when a terminal cover is removed.

The second frame 11B has an angular cylinder section 30 the front end of which facing the bottomed angular cylindrical section 21 of the first frame 11A is opened, as illustrated in FIGS. 1 and 2.

On the front face side of the angular cylinder section 30, power supply side terminal sections 31*a* and an auxiliary terminal section 32*a* and load side terminal sections 31*b* and an auxiliary terminal section 32*b* are formed on the upper side and the lower side, respectively. In the angular cylinder section 30, the contact mechanism 13 is arranged. Further, on the open end face on the rear side of the angular cylinder section 30, engaging protrusion sections 30*a* to which the hook sections 27 of the first frame 11A are locked and that compose the snap fits are formed, as illustrated in FIG. 1.

The contact mechanism 13 has four sets of fixed contacts 34*a* and 34*b*, each of which is fixed to a pair of contact fixing plate sections 33*a* and 33*b* each of which extends inward from either the upper or lower plate section of the second frame 11B and which are arranged in parallel to one another in the horizontal direction, as illustrated in FIG. 5. Out of the four sets of fixed contacts 34*a* and 34*b*, the fixed contacts 34*a* and the fixed contacts 34*b* compose the power supply side terminal sections 31*a* and the auxiliary terminal section 32*a* and the load side terminal sections 31*b* and the auxiliary terminal section 32*b*, respectively.

The contact mechanism 13 is provided with the contact support 36 that supports a set of four movable contacts 35 in such a way that both end sections thereof are opposed, from the front, to and separated from the fixed contacts 34*a* and 34*b* with a predetermined interspace.

The contact support 36 is made up of a movable contact support section 37 that holds the set of four movable contacts 35 arranged in a lateral row in a freely movable manner in the front and rear direction and an electromagnet connection section 40 that is formed integrally with the movable contact support section 37 on the rear side thereof, as illustrated in FIGS. 3 to 9.

The movable contact support section 37 has contact insertion space sections 38 into which the movable contacts 35 are inserted and held, and the movable contacts 35 are pressed rearward by contact springs 39 to be supported in the contact insertion spaces section 38, as illustrated in FIG. 5.

Figure 11:
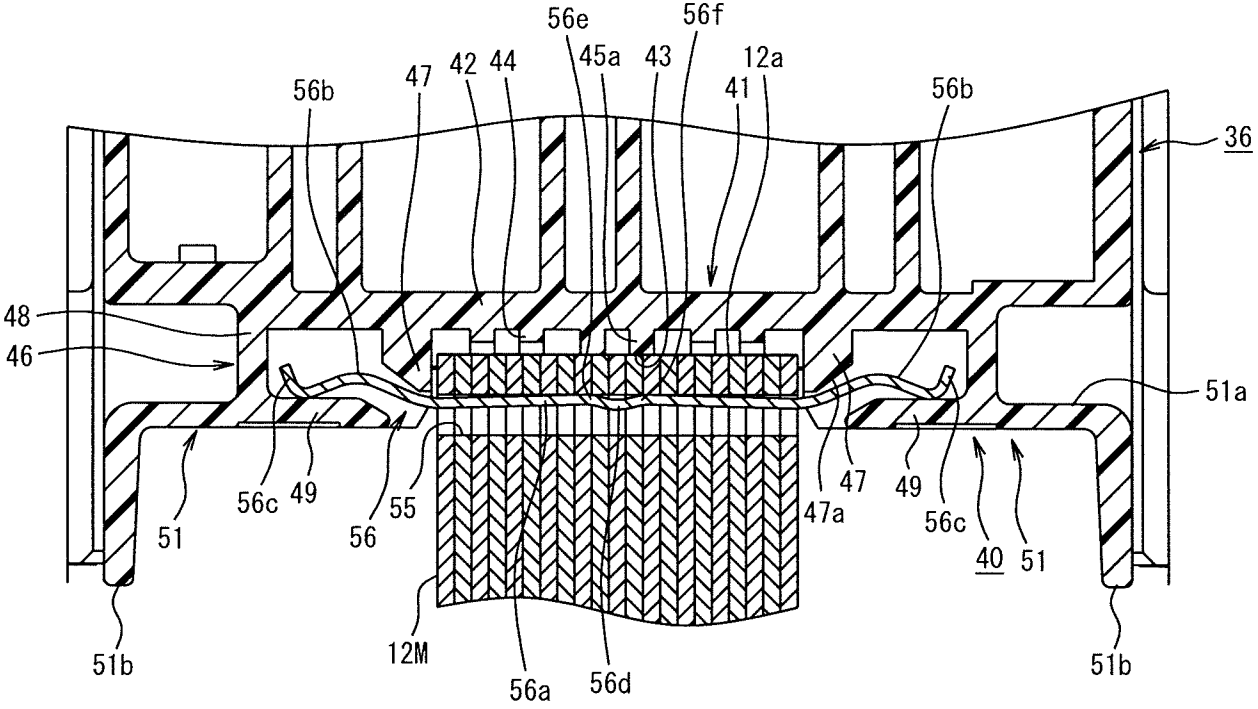
FIG. 11 is an enlarged cross-sectional view of an electromagnet connection section of the contact support.

The electromagnet connection section 40 is provided with a movable core contact section 41 with which a mounting surface of the movable core 12M of the AC electromagnet 12AC is brought into contact, connecting spring tip housing sections 46, and armature contact sections 51 with which an armature of a DC electromagnet can be brought into contact, as illustrated in an enlarged manner in FIG. 11.

Figure 8:
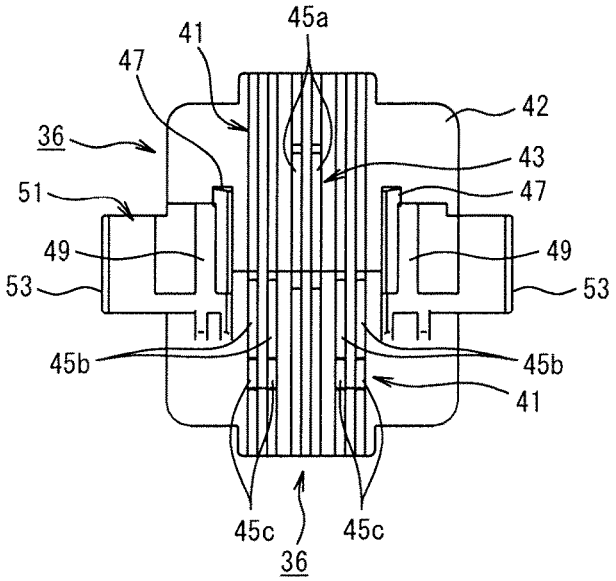
FIG. 8 is a bottom plan view of a contact support.
Figure 9:
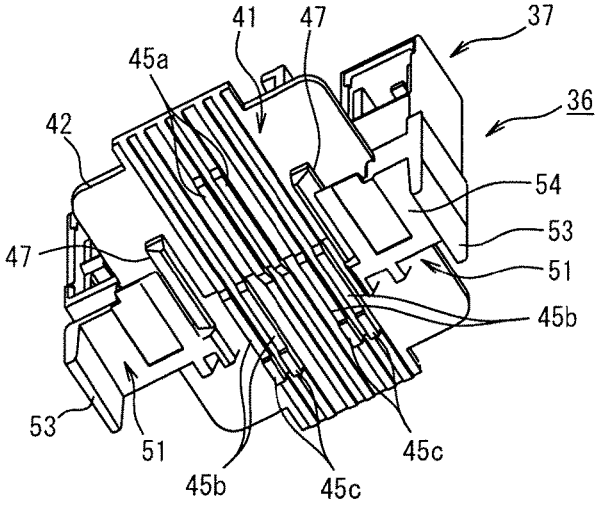
FIG. 9 is a perspective view of the contact support when viewed from the bottom side.

The movable core contact section 41 has a base plate section 42 that is formed integrally with the movable contact support section 37 on the rear end side thereof and extends vertically, and a movable core contact surface 43 is formed on an end face on the rear face side of the base plate section 42, as illustrated in FIGS. 8 and 9. On the movable core contact surface 43, a plurality of, for example, six, protruding lines 44 are formed along a direction in which the movable core 12M is slid to be fixed. Out of the protruding lines 44, on two middle protruding lines 44, movable core contact protruding lines 45*a* that protrude further frontward are formed at positions on the start side of the sliding of the movable core 12M, and, on each two outer protruding lines 44, movable core contact protruding lines 45*b* are formed at positions to which the movable core 12M is finally fixed. In addition, on the lower end side of the movable core contact protruding lines 45*b*, stopper sections 45*c* that come into contact with the movable core 12M to perform positioning thereof are formed.

The connecting spring tip housing sections 46 are each formed on both the right and left sides of the movable core contact section 41, as illustrated in FIG. 11. These connecting spring tip housing sections 46 are made up of partition walls 47 formed on both the right and left sides of the movable core contact section 41, partition walls 48 formed on the outer sides of the partition walls 47 at a predetermined interval, and spring support plate sections 49 extending from the front faces of the partition walls 48 toward the partition walls 47.

A spring insertion section 50 into which a connecting spring is inserted is opened between each partition wall 47 and spring support plate section 49, and one of the upper and lower end sections, for example, the upper end section, of each spring insertion section 50 is opened. On the rear end face of each partition wall 47, an inclined surface 47*a* the protrusion height of which decreases as it goes from the movable core contact section 41 side toward the outer side is formed.

The armature contact sections 51 are made up of plate sections 51*a* that extend from the partition wall 48 sides of the spring support plate sections 49 of the connecting spring tip housing sections 46 toward both the right and left outer sides and plate sections 51*b* that bend and extend rearward from both the right and left ends of these plate sections 51*a*. The rear faces of the plate sections 51*b* including the rear faces of the spring support plate section 49 serve as the armature contact sections 51.

As described above, the contact support 36 having the movable core contact section 41, with which the movable core 12M of the AC electromagnet 12AC is brought into contact, and the armature contact section 51, with which an armature of a polarized DC electromagnet is brought into contact, formed to the electromagnet connection section 40 enables both the above-described AC electromagnet 12AC and a not-illustrated polarized DC electromagnet to be connected.

Figure 10A:
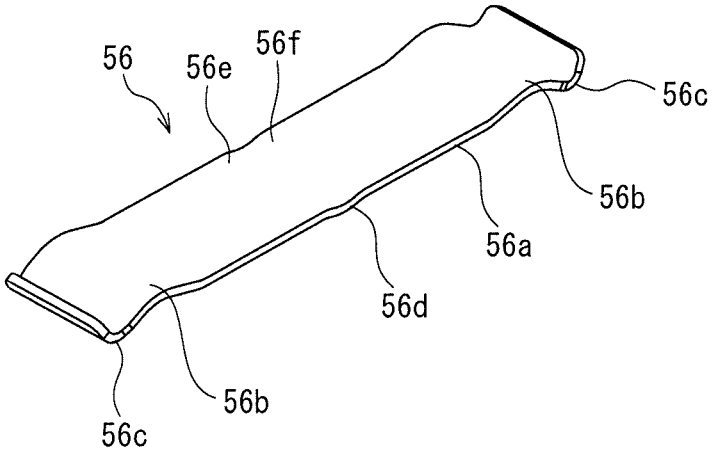
FIGS. 10A and 10B are perspective views illustrative of a connecting spring of the AC electromagnet.
Figure 10B:
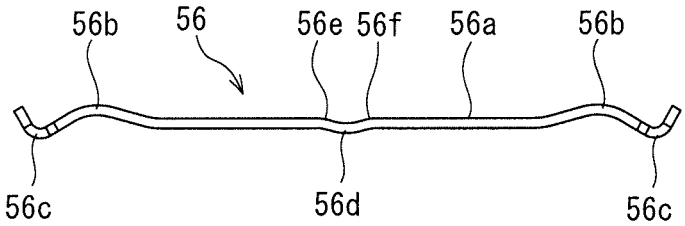

When the movable core 12M of the AC electromagnet 12AC is connected to the contact support 36, a connecting spring 56, which is illustrated in FIGS. 10A and 10B, is inserted into a through hole 55 for spring insertion, which is formed in a penetrating manner at the vertically central position of a vertical plate section of the movable core 12M, and the upper and lower end sections of the connecting spring 56, which project out of the movable core 12M, are inserted and fixed to the insides of the connecting spring tip housing sections 46, as illustrated in FIGS. 3 and 4.

The connecting spring 56 is made up of a movable core contact plate section 56*a* that is located at a central portion thereof and contacts the inside of the through hole 55 of the movable core 12M, a pair of curved bulge sections 56*b* that are formed on both end sides of the movable core contact plate section 56*a* and compose curved plate sections, and tip curved bulge sections 56*c* that are formed on both outer end sides of the curved bulge sections 56*b* and come into contact with the connecting spring tip housing sections 46, as illustrated in FIGS. 10A, and 10B, and 11.

To the movable core contact plate section 56*a*, a depressed section 56*d* that protrudes in a downward direction opposite to the direction toward the contact support 36 and extends in a direction orthogonal to the longitudinal direction is formed at a central section in the longitudinal direction. On both sides of the depressed section 56*d*, a pair of contact sections 56*e* and 56*f* are formed, which come into line contact with the inside of the through hole 55 of the movable core 12M. Within the movable core contact plate section 56*a*, plate sections outward from the pair of contact sections 56*e* and 56*f* are slightly inclined in a direction in which the plate sections gradually separate from the contact support 36 as it goes to both ends, as illustrated in FIG. 11. The length of the movable core contact plate section 56*a* in the longitudinal direction is set substantially equal to the width of the movable core 12M, as illustrated in FIGS. 3 and 4.

The curved bulge sections 56*b* are each formed integrally with the movable core contact plate section 56*a* at both ends in the longitudinal direction thereof, protrude while curving upward, and extend in a direction orthogonal to the longitudinal direction of the movable core contact plate section 56*a*. The tip curved bulge sections 56*c* are each formed integrally with the curved bulge sections 56*b* at both the right and left end sections thereof, protrude while curving downward, and extend in the direction orthogonal to the longitudinal direction of the movable core contact plate section 56*a*.

To connect the contact support 36 to the movable core 12M of the AC electromagnet 12AC, the movable core contact plate section 56*a* of the connecting spring 56 is inserted into the through hole 55 formed in a penetrating manner to the movable core 12M so that the contact sections 56*e* and 56*f* formed on both sides of the depressed section 56*d* face the contact support 36 side of the movable core 12M. At this time, the curved bulge sections 56*b* and the tip curved bulge sections 56*c* project out of the right and left side faces of the movable core 12M.

In this state, first, the movable core 12M is, by a contact surface 12*a* thereof, brought into contact with the movable core contact protruding lines 45*a* on the tip side of the movable core contact section 41 of the electromagnet connection section 40 of the contact support 36. When in this state, the curved bulge sections 56*b* and the tip curved bulge sections 56*c* of the connecting spring 56 face the connecting spring tip housing sections 46 of the contact support 36 from the upper end side.

Subsequently, while the movable core 12M is being slid downward, the curved bulge sections 56*b* of the connecting spring 56 are made to face the inclined surfaces 47*a* of the partition walls 47 and the tip curved bulge sections 56*c* are engaged with the inner surfaces of the spring support plate sections 49.

At this time, since the movable core contact protruding lines 45*a* are formed only at a central region in the horizontal direction of the base plate section 42, the movable core 12M can be inclined when the movable core 12M is brought into contact with the movable core contact protruding lines 45*a*. Thus, inclining the movable core 12M alternately enables the curved bulge sections 56*b* and the tip curved bulge sections 56*c* on the right and left sides of the connecting spring 56 to be inserted into the right and left connecting spring tip housing sections 46 alternately. Therefore, insertion of the connecting spring 56 into the connecting spring tip housing sections 46 can be performed easily.

Subsequently, the movable core 12M is further slid downward so that the contact surface 12*a* of the movable core 12M is brought into contact with the movable core contact protruding lines 45*b*, and, at a position where the contact surface 12*a* comes into contact with the stopper sections 45*c* of the movable core contact section 41, the sliding of the movable core 12M is stopped.

With this configuration, the contact surface 12*a* of the movable core 12M is brought into contact with the movable core contact surface 43 of the contact support 36 and the contact sections 56*e* and 56*f* of the connecting spring 56 come into contact with the upper surface of the through hole 55 in the movable core 12M, and, furthermore, the tip curved bulge sections 56*c* are engaged with the inner surfaces of the spring support plate sections 49 of the connecting spring tip housing sections 46, as illustrated in FIG. 11. Therefore, the elasticity of the connecting spring 56 brings the contact surface 12*a* of the movable core 12M into pressed contact with the movable core contact surface 43 of the electromagnet connection section 40 in the contact support 36.

With this feature, the movable core 12M of the AC electromagnet 12AC is connected to the contact support 36 by means of the connecting spring 56. On this occasion, the pair of contact sections 56*e* and 56*f* formed on both ends of the depressed section 56*d*, which is formed to the movable core contact plate section 56*a* of the connecting spring 56, each being in contact with the upper surface of the through hole 55 in the movable core 12M enables the movable core to be pressed against the movable core contact surface 43 of the contact support 36 without inclination.

The tip curved bulge sections 56*c* on both end sides, which serve as points of load of the connecting spring 56, being in contact with the spring support plate sections 49 of the connecting spring tip housing sections 46 enables loads exerted on these points of load to be equalized. In addition, even when a positional displacement in the width direction is caused to the connecting spring 56 in the through hole 55, the pair of contact sections 56*e* and 56*f* of the connecting spring 56 being securely in contact with the upper surface of the through hole 55 enables loads exerted on the points of load to be kept substantially equal, enabling the relative attitude between the movable core 12M and the contact support 36 to be stabilized instead of being distorted.

While the contact support 36 to which the movable core 12M is connected is supported in a movable manner in the second frame 11B, the second frame 11B is joined to the first frame 11A in which the fixed core 12F and the spool 12S are mounted. The joining between the first frame 11A and the second frame 11B in this case is carried out by means of snap-fit connection, which is achieved by the hook sections 27 formed to the first frame 11A being locked to the engaging protrusion sections 30*a* formed to the second frame 11B, to compose the electromagnetic contactor 10.

As described above, according to the above-described embodiment, the depressed section 56*d* that protrudes to a side opposite to the contact support 36 is formed in the movable core contact plate section 56*a* at the central section of the connecting spring 56, which connects the movable core 12M and the contact support 36, and, on both sides of the depressed section 56*d*, the pair of contact sections 56*e* and 56*f* that come into contact with the contact support 36 side of the through hole 55, which is formed in the movable core 12M, are formed. This causes the pair of contact sections 56*e* and 56*f* of the connecting spring 56 to press the movable core 12M to the contact support 36 side, enabling the contact surface 12*a* of the movable core 12M to be securely brought into contact with a movable core contact surface 43 of the contact support 36.

Therefore, it is possible to perform accurate positioning based on the movable core contact surface 43 of the contact support 36 to determine the relative attitude between the movable core 12M and the contact support 36. Even when the connecting spring 56 is displaced in the width direction in the through hole 55 of the movable core 12M, the pair of contact sections 56*e* and 56*f* being securely brought into contact with the contact support 36 side in the through hole 55 of the movable core 12M enables the movable core 12M and the contact support 36 to be connected to each other without the relative attitude therebetween being distorted.

Moreover, since the connecting spring 56 is not required to be formed into an arch shape as in the conventional example, it becomes possible to reduce the height of the movable core 12M in the height direction and to keep low the height of the electromagnet connection section 40 of the contact support 36 by this amount, enabling miniaturization of the electromagnetic contactor 10 to be achieved.

Figure 12:
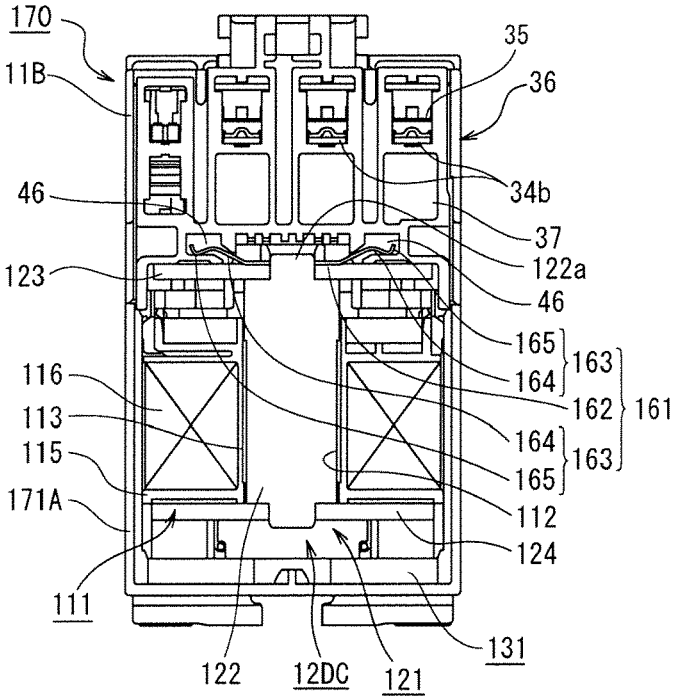
FIG. 12 is a cross-sectional view when a polarized DC electromagnet is connected to the contact support.

Since, as described above, the electromagnet connection section 40 of the contact support 36 that connects the operation electromagnet 12, which is composed of an AC electromagnet, can be made thinner, it becomes possible to connect an armature 70 of a polarized DC electromagnet 12DC to the contact support 36 by means of a connecting spring 71, as illustrated in FIG. 12, enabling standardization of the contact support 36 to be achieved.

Figure 13:
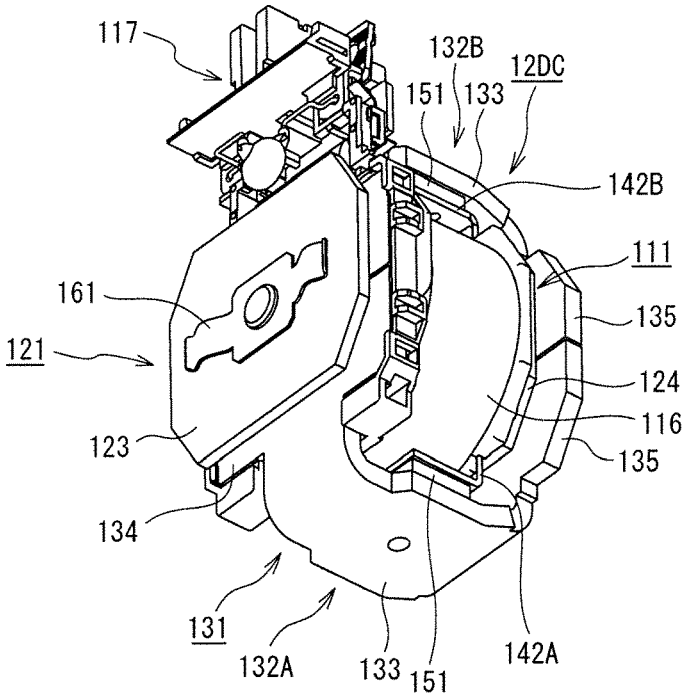
FIG. 13 is a perspective view illustrative of the polarized DC electromagnet in FIG. 12.

That is, the polarized DC electromagnet 12DC is provided with a spool 111, a plunger 121, an outer yoke 131, an inner yoke 141, and permanent magnets 151, as illustrated in FIGS. 12 and 13.

The spool 111 has a cylinder section 113 that has a central opening 112 and flange sections 114 and 115 that project in the radial direction at the end sections in the axial direction, that is, the upper and lower end sections, of the cylinder section 113, respectively, as illustrated in FIG. 12. An excitation coil 116 is wound around the outer periphery of the cylinder section 113 between the flange sections 114 and 115. Furthermore, coil terminals 117 to energize the excitation coil 116 are mounted, as illustrated in FIG. 13.

The plunger 121 is made up of a cylindrical bar-shaped section 122 that is inserted into the central opening 112 of the spool 111 and a first armature 123 and a second armature 124 that are formed in a radially projecting manner at both end sections in the axial direction of the bar-shaped section 122, which project out of the central opening 112, as illustrated in FIG. 12.

The outer yoke 131 is made up of a right-and-left pair of yoke half bodies 132A and 132B that are opposed to each other with the spool 111 interposed therebetween and are formed in C-shapes, as illustrated in FIG. 13.

The inner yoke 141 is made up of yoke half bodies 142A and 142B that are formed in L-shapes and are arranged on the inside of the yoke half bodies 132A and 132B of the outer yoke 131 with a predetermined gap kept therebetween, as illustrated in FIG. 13.

The permanent magnets 151 are arranged in such a way as to be each interposed between the yoke half body 132A and 132B of the outer yoke 131 and the yoke half body 142A and 142B of the inner yoke 141 that are opposed thereto, as illustrated in FIG. 13.

The first armature 123 of the polarized DC electromagnet 12DC has a DC electromagnet connecting spring 161 fixed on the front surface thereof by means of caulking, as illustrated in FIGS. 12 and 13. The DC electromagnet connecting spring 161 is made up of a flat plate section 162 located at a central portion and curved plate sections 163 that are formed integrally with the flat plate section 162 on both end sides in the longitudinal direction thereof.

Connection of the polarized DC electromagnet 12DC to the contact support 36 is achieved by mounting the polarized DC electromagnet 12DC thereon in such a way that the front surface of the first armature 123 is brought into contact with the armature contact section of the contact support 36, and tip curved bulge sections 165 of the curved plate sections 163 of the DC electromagnet connecting spring 161 are, while being bent toward the front side, brought into contact with the inner surfaces of the spring support plate sections of the connecting spring tip housing sections.

Subsequently, while the polarized DC electromagnet 12DC and the contact support 36 are in a state of being connected integrally by the DC electromagnet connecting spring 161, the polarized DC electromagnet 12DC is contained in a first frame 171A, which has the same external shape as the afore-described first frame 11A, as illustrated in FIG. 12. In this state, snap-fitting the afore-described second frame 11B to the first frame 171A so as to house the contact support 36 in a slidable manner enables an electromagnetic contactor 170 to be composed.

Therefore, it is not required to provide contact supports 36 separately to an AC electromagnet and to a DC electromagnet, that is, both an AC electromagnet and a DC electromagnet can be connected to a common contact support 36, enabling the number of components to be reduced and a production cost of an electromagnetic contactor to be reduced.

Although, in the above-described embodiment, a case in which the movable core contact section 41 of the electromagnet connection section 40 is formed in the direction orthogonal to the aligning direction of the movable contacts 35 was described, the movable core contact section 41 may, without being limited to the case, be formed in a direction crossing the aligning direction of the movable contacts.

Although, in the above-described embodiment, a case in which the depressed section 56*d* formed in the connecting spring 56 is formed in the direction orthogonal to the longitudinal direction of the movable core contact plate section 56*a* was described, the depressed section 56*d* may, without being limited to the case, be formed in a direction crossing the longitudinal direction of the movable core contact plate section 56*a*.

REFERENCE SIGNS LIST

10 electromagnetic contactor
11A first frame
11B second frame
12 operation electromagnet
12F fixed core
12M movable core
12AC AC electromagnet
13 contact mechanism
21 bottomed angular cylindrical section
30 angular cylinder section
31*a* power supply side terminal section
31*b* load side terminal section
32*a*, 32*b* auxiliary terminal section
34*a*, 34*b* fixed contact
35 movable contact
36 contact support
37 movable contact support section
40 electromagnet connection section
41 movable core contact section
46 connecting spring tip housing section
49 spring support plate section
51 armature contact section
55 through hole
56 connecting spring
56*a* movable core contact plate section
56*b* curved bulge section
56*c* tip curved bulge section

The invention claimed is:

1. An electromagnetic contactor comprising:

an AC electromagnet having a fixed core and a movable core;

a contact support that aligns and holds a plurality of movable contacts; and a connecting spring that connects the movable core of the AC electromagnet and the contact support, wherein the connecting spring includes:

a movable core contact plate section that is inserted into a through hole formed in the movable core and comes into contact with the contact support side of the through hole; and a pair of curved plate sections that are each joined to either end of the movable core contact plate section and housed in connecting spring tip housing sections formed in the contact support, the pair of curved plate sections coming into contact with the connecting spring tip housing sections on sides opposite to a contact surface of the movable core contact plate section, and wherein, in the movable core contact plate section, a depressed section that is formed in a direction crossing a longitudinal direction of the movable core contact plate section and bulges out to an opposite side to the contact support side is formed, and a pair of contact sections that individually come into contact with the through hole are formed on both ends of the depressed section.

2. The electromagnetic contactor according to claim 1, wherein the depressed section of the connecting spring is formed in a direction orthogonal to the longitudinal direction of the movable core contact plate section, and the pair of contact sections come into line contact with the through hole.

3. The electromagnetic contactor according to claim 2, wherein the contact support has a movable core contact section with which a mounting surface of the movable core is brought into contact and that extends in a direction crossing an aligning direction of the movable contacts, and the connecting spring tip housing sections are formed adjacent to the movable core contact section in the aligning direction of the movable contacts.

4. The electromagnetic contactor according to claim 1, wherein the connecting spring tip housing sections have support plate sections that support bulge sections of the pair of curved plate sections of the connecting spring.

5. The electromagnetic contactor according to claim 2, wherein the connecting spring tip housing sections have support plate sections that support bulge sections of the pair of curved plate sections of the connecting spring.

6. The electromagnetic contactor according to claim 1, wherein the contact support has a movable core contact section with which a mounting surface of the movable core is brought into contact and that extends in a direction crossing an aligning direction of the movable contacts, and the connecting spring tip housing sections are formed adjacent to the movable core contact section in the aligning direction of the movable contacts.

7. The electromagnetic contactor according to claim 6, wherein the connecting spring tip housing sections have support plate sections that support bulge sections of the pair of curved plate sections of the connecting spring.

8. The electromagnetic contactor according to claim 3, wherein the connecting spring tip housing sections have support plate sections that support bulge sections of the pair of curved plate sections of the connecting spring.

* * * * *